US006143043A

United States Patent [19]

Botros

[11] Patent Number: 6,143,043

[45] Date of Patent: Nov. 7, 2000

[54] CLOUD POINT DEPRESSANTS FOR MIDDLE DISTILLATE FUELS

[75] Inventor: Maged G. Botros, West Chester, Ohio

[73] Assignee: Equistar Chemicals, LP, Houston, Tex.

[21] Appl. No.: 09/351,652

[22] Filed: Jul. 13, 1999

[51] Int. Cl.[7] ..... C10L 1/22

[52] U.S. Cl. ..... 44/346; 44/347

[58] Field of Search ..... 44/346, 347; 525/327.6, 525/379

[56] References Cited

U.S. PATENT DOCUMENTS

| | | |
|---|---|---|
| 2,615,845 | 10/1952 | Lippincott et al. . |
| 2,698,316 | 12/1954 | Giammaria . |
| 3,413,104 | 11/1968 | Mehmedbasich . |
| 3,458,295 | 7/1969 | Mehmedbasich . |
| 3,909,215 | 9/1975 | Kray . |
| 4,537,601 | 8/1985 | Naiman . |
| 5,766,273 | 6/1998 | Dralle-Voss et al. . |

*Primary Examiner*—Jerry D. Johnson
*Attorney, Agent, or Firm*—Shao Guo

[57] ABSTRACT

An additive for distillate and a fuel composition having improved cloud point depressant properties. The additive is incorporated into a major proportion of distillate fuel and is a maleic anhydride α-olefin copolymer or a polyimide having the following structure:

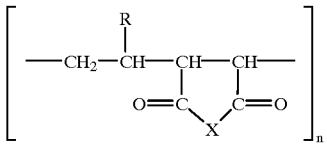

wherein R has at least 80% by weight of a hydrocarbon substituent from about 14 to about 16 carbons, X is oxygen or

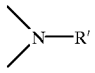

wherein N is nitrogen and R' has at least 80% by weight of a hydrocarbon substituent from 16 to 18 carbons, and n is from about 2 to about 30 when X is oxygen, and from about 2 to about 17 when X is

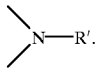

Alternatively, the cloud point additive can be an ethylene vinyl acetate isobutylene terpolymer.

7 Claims, No Drawings

CLOUD POINT DEPRESSANTS FOR MIDDLE DISTILLATE FUELS

FIELD OF THE INVENTION

This invention relates to an improved fuel composition and fuel additives which are useful as cloud point depressants.

BACKGROUND OF THE INVENTION

Distillate fuels such as diesel fuels tend to exhibit reduced flow at reduced temperatures. This reduced flow affects the transport and use of the distillate fuels not only in the refinery but also in an internal combustion engine. If the distillate fuel is cooled to below a temperature at which solid formation begins to occur in the fuel, generally known as the cloud point (ASTM D 2500) or wax appearance point (ASTM D 3117), solids forming in the fuel will essentially prevent the flow of the fuel, plugging piping in the refinery, during transport of the fuel, and in inlet lines supplying an engine. Under low temperature conditions during consumption of the distillate fuel, as in a diesel engine, wax precipitation and gelation can cause the engine fuel filter to plug.

As used herein, distillate fuels encompass a range of fuel types, typically including but not limited to kerosene, intermediate distillates, lower volatility distillate gas oils, and higher viscosity distillates. Grades encompassed by the term include Grades No. 1-D, 2-D and 4-D for diesel fuels as defined in ASTM D 975, incorporated herein by reference. The distillate fuels are useful in a range of applications, including use in automotive diesel engines and in non-automotive applications under both varying and relatively constant speed and load conditions.

The cloud point of a fuel is the temperature at which a cloud of wax crystals first appears in a liquid when it is cooled under conditions prescribed in the test method as defined in ASTM D 2500, incorporated herein by reference. The cloud point behavior of a distillate fuel such as diesel fuel is a function of its composition. The fuel is comprised of a mixture of hydrocarbons including normal paraffins, branched paraffins, olefins, aromatics and other non-polar and polar compounds. As the diesel fuel temperature decreases at the refinery, during transport, or in a vehicle, one or more components of the fuel will tend to separate, or precipitate. The cloud point of the fuel is defined as the temperature at which the first waxes appear. The cloud point corresponds to an equilibrium state based on thermodynamic relationships which determine the solubility of paraffins in the diesel fuel.

Additives to decrease the cloud point, also known as cloud point depressants, have been used in fuels to delay the formation of solid wax crystals and thereby aid in enhancing the operability of the fuel. In addition, a cloud point depressant may also provide economic benefits in connection with the refining of the diesel fuel. To reach a particular cloud point specification, a certain amount of hydrocarbons in the kerosene boiling range are left in the diesel fuel fraction. A cloud point depressant will typically lower the cloud point by 2 to 3° C. This lowering of the cloud point temperature by the depressant is known to compensate for the backing out of 20 to 30% of the kerosene fraction originally required to meet the cloud point specification.

The components of the diesel fuel having the lowest solubility tend to be the first to separate as solids from the fuel with decreasing temperature. Straight chain hydrocarbons, such as normal paraffins, generally have the lowest solubility in the diesel fuel, Generally, the paraffin crystals which separate from the diesel fuel appear as individual crystals. As more crystals form in the fuel, they tend to agglomerate and eventually reach a particle size which becomes visible to the eye and creates a cloudy appearance.

It is known to incorporate additives into diesel fuel to enhance the flow properties of the fuel at low temperatures. These additives are generally viewed as operating under either or both of two primary mechanisms. In the first, the additive molecules have a configuration which allow them to interact with the n-paraffin molecules at the growing ends of the paraffin crystals. The interacting additive molecules by steric effects act as a cap to prevent additional paraffin molecules from adding to the crystal, thereby limiting the length of the existing crystal.

In the second mechanism, the flow modifying additive may improve the flow properties of diesel fuel at low temperatures by functioning as a nucleator to promote the growth of smaller size crystals.

Additional, secondary, mechanisms involving the modification of wax properties in the fuel by incorporation of additives include, but are not limited to, dispersal of the wax in the fuel and solubilization of the wax in the fuel.

The range of available diesel fuels includes Grade No. 2-D, defined in ASTM D 975-90 as a general purpose, middle distillate fuel for automotive diesel engines, which is also suitable for use in non-automotive applications, especially in conditions of frequently varying speed and load. Certain of these Grade No. 2-D (No. 2) fuels may be classified as being hard to treat when using one or more additives to improve flow. A hard-to-treat diesel fuel is either unresponsive to a flow improving additive, or requires increased levels of one or more additives relative to a normal fuel to effect flow improvement.

Fuels in general, and diesel fuels in particular, are mixtures of hydrocarbons of different chemical types (i.e., paraffins, aromatics, olefins, etc.) wherein each type may be present in a range of molecular weights and carbon lengths. The cloud point temperature is a function of one or more properties of the fuel, the properties being attributable to the composition of the fuel. These properties include the paraffin concentration of the fuel, the molecular weight of the paraffins, and the chemical nature of the non-paraffin part of the fuel. For example, in the case of a hard-to-treat fuel the compositional properties which render a fuel hard to treat relative to normal fuels include a narrower wax distribution; the virtual absence of very high molecular weight waxes, or inordinately large amounts of very high molecular weight waxes; a higher total percentage of wax; and a higher average normal paraffin carbon number range. It is difficult to generate a single set of quantitative parameters which define a hard-to-treat fuel. Nevertheless, measured parameters which tend to identify a hard-to-treat middle distillate fuel include a temperature range of less than 100° C. between the 20% distilled and 90% distilled temperatures (as determined by test method ASTM D 86 incorporated herein by reference), a temperature range less than 25° C. between the 90% distilled temperature and the final boiling point (see ASTM D 86), and a final boiling point above or below the temperature range 3600 to 380° C.

A fuel will cool to its cloud point generally in a static environment, but will also become cloudy in a dynamic environment such as a moving fuel tank at sufficiently low temperature. There continues to be a demand for additives which improve the cloud point characteristics of distillate fuels. Because additives are incorporated into the fuel to improve distinct characteristics of the fuel, it is possible that one additive may have an antagonistic effect on another additive. It is therefore desired that the cloud point additive not demonstrate an antagonism to the characteristics of the fuel as to one or more other properties, such as cold flow or wax anti-settling properties. Further, there remains a need for additive compositions which are capable of depressing the cloud point of hard-to-treat fuels.

SUMMARY OF THE INVENTION

It has been found that certain polyimide and maleic anhydride olefin polymer additives with carbon substituent chain lengths within a specified range, and alternatively certain ethyl vinyl acetate isobutylene terpolymers will depress the cloud point of certain distillate fuels such as No. 2 diesel fuel. Also, the above polyimide and maleic anhydride olefin polymer additives in combination with other materials such as ethylene vinyl acetate isobutylene terpolymers demonstrate substantial improvement in depressing the cloud point of certain distillate fuels when incorporated therein. With the latter additive combinations the cold flow properties of the distillate fuels are not adversely affected by the incorporation of the polyimide or maleic anhydride olefin polymer additive.

Copending application Serial No. 09/311,465 is directed to certain maleic anhydride α-olefin copolymer and polyimide additives incorporated into distillate fuel to improve the wax anti-settling properties of the fuel. Copending application Ser. No. 09/311,459 is directed to the combination of an ethylene vinyl acetate isobutylene terpolymer with one or more additive components including certain maleic anhydride α-olefin copolymer and polyimide components to effect cold flow improvement in distillate fuels.

The maleic anhydride olefin copolymer additive is prepared by the reaction of maleic anhydride with α-olefin. Generally this copolymer additive contains substantially equimolar amounts of maleic anhydride and α-olefin. The operative starting α-olefin is a mixture of individual α-olefins having a range of carbon numbers. The starting α-olefin composition used to prepare the maleic anhydride olefin copolymer additive of the invention has at least a minimum α-olefin concentration by weight with a carbon number within the range from about $C_{16}$ to about $C_{18}$. The additive generally does not contain α-olefin of a single carbon number; thus the additive consists of blends of α-olefins having carbon numbers within this range. The operative starting α-olefin may have a minor component portion which is outside the above carbon number range. The maleic anhydride α-olefin copolymers have a number average molecular weight in the range of about 700 to about 10,000 as measured by vapor pressure osmometry.

The invention also encompasses a cloud point depressant comprising a polyimide produced by the reaction of an alkyl amine, maleic anhydride and α-olefin. Generally the polyimide is produced from substantially equimolar amounts of maleic anhydride and α-olefin. The operative α-olefin is similar in composition to that described above for the maleic anhydride olefin copolymer additive, having a carbon number range from about $C_{16}$ to about $C_{18}$. Particularly advantageous cloud point depressant properties are obtained when the alkyl amine is tallow amine. The polyimide has a number average molecular weight in the range of about 1,200 to about 10,000, preferably in the range of about 1,200 to about 5,000, as measured by vapor pressure osmometry.

The ethylene vinyl acetate isobutylene terpolymer additive has a weight average molecular weight in the range of about 1,500 to about 18,000, preferably about 3,000 to about 12,000; a number average molecular weight in the range of about 400 to about 3,000, preferably about 1,500 to about 2,500; and a ratio of weight average molecular weight to number average molecular weight from about 1.5 to about 6.

DETAILED DESCRIPTION OF THE INVENTION

It has been found that unexpectedly advantageous cloud point depressing properties can be imparted to distillate fuels by incorporating an additive having the following structure:

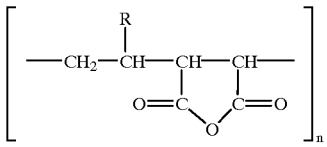

wherein R has at least 80% by weight of a hydrocarbon substituent from about 14 to about 16 carbons, and n is from about 2 to about 30. Preferably R has at least 90% by weight of a hydrocarbon substituent from about 14 to about 16 carbons, and most preferably R has at least 95% by weight of a hydrocarbon substrate from about 14 to about 16 carbons. The resulting maleic anhydride α-olefin copolymer has a number average molecular weight in the range of about 700 to about 10,000, and preferably in the range of about 700 to about 4,000, as determined by vapor pressure osmometry.

The cloud point depressant additive of this invention typically encompasses a mixture of hydrocarbon substituents of varying carbon number within the recited range, and encompasses straight and branched chain moieties.

It has also been found that an additive of the structure

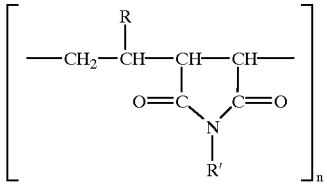

wherein R has at least 80% by weight of a hydrocarbon substituent from about 14 to about 16 carbons, R' has at least 80% by weight of a hydrocarbon substituent from 16 to 18 carbons, and n is from about 2 to about 17, also has cloud point depressant properties. Preferably R has at least 90% by weight of a hydrocarbon substituent from about 14 to about 16 carbons, and most preferably R has at least 95% by weight of a hydrocarbon substituent from about 14 to about 16 carbons. Typically, R' has at least 90% by weight of a hydrocarbon substituent from 16 to 18 carbons. The above additive, described as a polyimide, has a number average molecular weight as determined by vapor pressure osmometry in the range of about 1,200 to about 10,000, and preferably in the range of about 1,200 to about 5,000.

In addition, it has been found that certain ethylene vinyl acetate isobutylene terpolymers demonstrate cloud point depressant properties both alone and in combination with one or more of the above maleic anhydride α-olefin copolymer or polyimide additives. Useful ethylene vinyl acetate isobutylene terpolymers have a weight average molecular weight in the range of about 1,500 to about 18,000, a number average molecular weight in the range of about 400 to about 3,000, and a ratio of weight average molecular weight to number average molecular weight from about 1.5 to about 6. Preferably the weight average molecular weight ranges from about 3,000 to about 12,000, and the number average molecular weight ranges from about 1,500 to about 2,500. The terpolymers have a Brookfield viscosity in the range of about 100 to about 300 centipoise at 140° C. Typically the Brookfield viscosity is in the range of about 100 to about 200 centipoise. Vinyl acetate content is from about 25 to about 55 weight percent. Preferably the vinyl acetate content ranges from about 30 to about 45 weight percent; more preferably the vinyl acetate content ranges from about 35 to about 45 weight percent. The branching index is from 2 to 15, and preferably 5 to 10. The rate of isobutylene introduction depends on the rate of vinyl acetate introduction, and may range from about 0.01 to about 10 times the rate of vinyl acetate monomer flow rate to the reactor.

A fuel will cool to its cloud point generally in a static environment, such as storage tanks, shipping tanks or even fuel tanks where no separate agitation is supplied. However, a fuel will become cloudy even in a dynamic environment such as a moving fuel tank at sufficiently low temperature. To replicate the conditions which promote formation of a cloud point and permit evaluation of additives, ASTM D 2500 for measuring cloud point formation or ASTM D 3117 for measuring the wax appearance point, both incorporated herein by reference, can be utilized.

Optionally, the maleic anhydride α-olefin copolymer or polyimide can be combined with an ethylene vinyl acetate isobutylene terpolymer or ethylene vinyl acetate copolymer to produce a cloud point depressant additive combination which also provides cold flow improvement without adversely affecting the cloud point depressant properties.

The maleic anhydride α-olefin copolymer or polyimide additives of the present invention act as cloud point depressants when effective amounts are added to distillate fuels. Useful amounts of the additives range from about 50 to about 1,500 ppm by weight of the fuel being treated. Preferred amounts of the additives to improve cloud point depressant properties range from about 250 to about 500 ppm by weight of treated fuel. Maleic anhydride α-olefin copolymers and polyimides used according to the teachings of this invention may be derived from α-olefin products such as those manufactured by Chevron Corporation and identified as Gulftene® 18 Alpha-Olefin, or the like.

Useful amounts of the terpolymers range from about 10 to about 1,000 ppm by weight of the fuel being treated. Preferred amounts of terpolymers range from about 25 to about 250 ppm by weight of treated fuel in connection with improving cloud point depression.

The additives of this invention may be used as the sole additive in a distillate fuel. Also, the polyimide or maleic anhydride α-olefin copolymers may be used in combination with one or more terpolymers or copolymers as described above. In addition, cloud point depressant additives of this invention may be used in combination with other fuel additives such as corrosion inhibitors, antioxidants, sludge inhibitors, cold flow improvers, wax anti-settling agents, and the like.

OPERATING EXAMPLES

The following detailed operating examples illustrate the practice of the invention in its most preferred form, thereby enabling a person of ordinary skill in the art to practice the invention. The principles of this invention, its operating parameters and other obvious modifications thereof, will be understood in view of the following detailed procedure.

In evaluating cloud point performance the additive combinations described below were combined with a variety of diesel fuels at a weight concentration of about 50–1,500 ppm additive combination in the fuel, preferably 250–500 ppm additive combination in the fuel. Higher additive concentrations tend to impart additional cloud point depression effects to the fuel; however, the rate of improvement is lower at concentration levels above about 500 ppm when compared to the rate of improvement at levels below about 500 ppm. In all evaluations herein the additive or additive combination was combined with the fuel from a concentrate. One part of a 1:1 weight mixture of additive and xylene was combined with 19 parts by weight of the fuel to be evaluated to prepare the concentrate. The actual final weight concentration of additive in the fuel was adjusted by varying the appropriate amount of the concentrate added to the fuel. If more than one additive was incorporated into the fuel, individual additive concentrates were mixed into the fuel substantially at the same time.

It has been found that the effectiveness of maleic anhydride α-olefin copolymer and polyimide as cloud point depressant additives is related to the structure of the additive. The α-olefin used in making the above additives is a mixture of individual α-olefins having a range of carbon numbers. The starting α-olefin used to prepare both the maleic anhydride olefin copolymer and polyimide additives of the invention has at least a minimum concentration by weight which has a carbon number within the range from about $C_{16}$ to about $C_{18}$.

The substituent "R" in the above formulas will have carbon numbers which are two carbons less than the α-olefin length, two of the α-olefin carbons becoming part of the polymer chain directly bonded to the repeating maleic anhydride or polyimide rings. Generally, α-olefins are not manufactured to a single carbon chain length, and thus the manufactured product will consist of component portions of individual α-olefins of varying carbon chain length. In addition, the substituent "R'" used in the polyimide cloud point additive will also have a minimum concentration within a range of carbon numbers.

Tallow amine is useful to introduce the R' substituent in connection with polyimide manufacture, and is generally derived from tallow fatty acid. Thus, the range and percentage of carbon numbers for the components of the tallow amine will generally be those of tallow fatty acid. Tallow fatty acid is generally derived from beef tallow or mutton tallow. Though the constituent fatty acids may vary substantially in individual concentration in the beef tallow or mutton tallow based on factors such as source of the tallow, treatment and age of the tallow, general values have been generated and are provided in the table below. The values are typical rather than average.

TALLOW COMPOSITION TABLE

| | Constituent Fatty Acids (g/100 g Total Fatty Acids) | | | | |
|---|---|---|---|---|---|
| | Saturated | | | Unsaturated | |
| Fat | Myristic ($C_{14}$) | Palmitic ($C_{16}$) | Stearic ($C_{18}$) | Oleic ($C_{18:1}$) | Linoleic ($C_{18:2}$) |
| Beef Tallow | 6.3 | 27.4 | 14.1 | 49.6 | 2.5 |
| Mutton Tallow | 4.6 | 24.6 | 30.5 | 36.0 | 4.3 |

Source: CRC Handbook of Chemistry and Physics, 74$^{th}$ ed. (1993–1994); p. 7–29.

The fatty acids from beef or mutton tallow can also be hydrogenated to lower the degree of unsaturation. Thus a tallow amine may contain a major portion by weight of unsaturated amine molecules, and alternatively with sufficient hydrogenation treatment may contain virtually no unsaturated amine molecules. Even with variations in tallow amine composition referred to above it is expected that the concentration by weight of hydrocarbon substituents from 16 to 18 carbons will be at least 80% by weight, and typically at least 90% by weight.

The following table lists maleic anhydride α-olefin copolymer and polyimide additives with their carbon number distributions for the various substituents of the additives tested. The percentages by weight of the carbon number ranges for the starting α-olefins were determined by using a Hewlett Packard HP-5890 gas chromatograph with a Chrompack WCOT (wool coated open tubular) Ulti-Metal 10 m×0.53 mm×0.15 μm film thickness column, with an HT SIMDIST CB coating. The sample was introduced via on-column injection onto the column as a solution in toluene. The gas chromatograph was equipped with a hydrogen flame ionization detector. A temperature program was activated to sequentially elute individual isomers. Because two carbons of the α-olefin become part of the polymer chain directly bonded to the repeating maleic anhydride or polyimide rings, the listed ranges for the "R" substituent shown in Table 1 are two carbons lower than the actual range determined chromatographically. Also, the listed ranges may encompass isomers having the same carbon number.

The copolymers and terpolymers utilized individually in preparing the various additive combinations are characterized in Table 2 set out below.

TABLE 2

| Additive | Viscosity @ 140° C. (cP) | Vinyl Acetate Content (wt. %) | Mn | Mw | Mw/Mn |
|---|---|---|---|---|---|
| Terpolymer I | 125 | 37 | 2,237 | 11,664 | 5.2 |
| Terpolymer II | 190 | 42 | 1,902 | 3,326 | 1.7 |
| Terpolymer III | 135 | 45 | 2,067 | 6,438 | 3.1 |
| Copolymer I | 115 | 32 | 1,889 | 3,200 | 1.69 |

Fuels included in the evaluation of additives for cloud point depression performance are listed below in Table 3, which provides distillation data for the respective fuels according to test method ASTM D 86. The data indicate the boiling point temperature (° C.) at which specified volume percentages of the fuel have been recovered from the original pot contents at atmospheric pressure.

TABLE 1

| Additive | R Substituent (% By Weight)[2] | | | | | | | | | R' Substituent | | | |
|---|---|---|---|---|---|---|---|---|---|---|---|---|---|
| | $C_{12}$ | $C_{14}$ | $C_{16}$ | $C_{18}$ | $C_{22-26}$ | $C_{28-38}$ | $C_{40-48}$ | $C_{50-58}$ | $C_{60-76}$ | H | $C_{16}$ | $C_{18}$ | n |
| Polyimide I | — | 1.3 | 98.4 | 0.3 | — | — | — | — | — | — | 26.0[1] | 68.5[1] | 2.95 |
| Polyimide II | 99.3 | 0.6 | — | — | — | — | — | — | — | 100 | — | — | — |
| Polyimide III | — | — | — | — | 80.5 | 14 | 3.2 | 1.8 | 0.4 | 100 | — | — | — |
| Polyimide IV | — | — | — | — | 12.3 | 58.5 | 15.9 | 10 | 3.3 | — | 26.0[1] | 68.5[1] | 1.13 |
| Polyimide V | — | — | — | — | 12.3 | 58.5 | 15.9 | 10 | 3.3 | 100 | — | — | — |
| Maleic Copolymer I | — | 1.3 | 98.4 | 0.3 | — | — | — | — | — | — | — | — | 4.1 |
| Maleic Copolymer II | 99.3 | 0.6 | — | — | — | — | — | — | — | — | — | — | 10.6 |
| Maleic Copolymer III | — | — | — | — | 12.3 | 58.5 | 15.9 | 10 | 3.3 | — | — | — | 3.41 |
| Maleic Copolymer IV | — | — | — | — | 80.5 | 14 | 3.2 | 1.8 | 0.4 | — | — | — | 3.6 |
| Maleic Copolymer V | 24.8 | 0.5 | 24.6 | 0.1 | 23.2 | 18.1 | 4.8 | 3.0 | 0.9 | — | — | — | 5.4 |

[1]Average representative figures, based on Tallow Composition Table.
[2]Total weight may not be 100% as a result of the presence of trace amounts of other materials, and rounding for calculation purposes.

TABLE 3

| Fuel | Percentage Distilled/Temperature (° C.) | | | | | | | | | | | | | |
|---|---|---|---|---|---|---|---|---|---|---|---|---|---|---|
| | Initial B.P. | 5% | 10% | 20% | 30% | 40% | 50% | 60% | 70% | 80% | 90% | 95% | Final B.P. | % Residue |
| 1 | 222 | 239 | 244 | 251 | 260 | 268 | 274 | 283 | 293 | 305 | 322 | 334 | 356 | 0.2 |
| 2 | 178 | 204 | 213 | 226 | 237 | 249 | 259 | 270 | 283 | 297 | 314 | 327 | 352 | 0.6 |
| 3 | 183 | 217 | 231 | 249 | 262 | 272 | 282 | 292 | 303 | 314 | 336 | 354 | 357 | 0.1 |
| 4 | 193 | 206 | 216 | 243 | 255 | 266 | 278 | 284 | 292 | 308 | 332 | 336 | 346 | 1.4 |
| 5 | 196 | 214 | 229 | 246 | 257 | 267 | 273 | 287 | 298 | 309 | 323 | 336 | 356 | 0.8 |
| 6 | 173 | 198 | 211 | 228 | 241 | 253 | 263 | 273 | 284 | 297 | 313 | 325 | 352 | 0.2 |
| 7 | 219 | 227 | 236 | 245 | 253 | 263 | 276 | 289 | 304 | 320 | 338 | 347 | 370 | 1.0 |
| 8 | 167 | 202 | 222 | 244 | 255 | 264 | 274 | 284 | 297 | 310 | 328 | 338 | 367 | 1.6 |
| 9 | 186 | 201 | 208 | 226 | 238 | 252 | 263 | 276 | 290 | 307 | 333 | 351 | 364 | 1.0 |
| 10 | 194 | 206 | 218 | 230 | 238 | 256 | 268 | 282 | 296 | 311 | 337 | 353 | 356 | 1.6 |

To evaluate whether the diesel fuels listed in Table 3 would be considered hard to treat, the temperature difference between the 20% distilled and 90% distilled temperatures (90%–20%), and 90% distilled temperature and final boiling point (90%-FBP) were calculated. Also, the final boiling point was included. The data are provided in Table 4. A 90%–20% temperature difference of about 100°–120° C. for a middle distillate cut fuel is considered normal; a difference of about 70°–100° C. is considered narrow and hard to treat; and a difference of less than about 70° C. is considered extreme narrow and hard to treat. A 90%-FBP temperature difference in the range of about 25° C. to about 35° C. is considered normal; a difference of less than about 25° C. is considered narrow and hard to treat; and a difference of more than about 35° C. is considered hard to treat. A final boiling point below about 360° C. or above about 380° C. is considered hard to treat. Distillation data were generated by utilizing the ASTM D 86 test method. Additional disclosure on hard-to-treat fuels is found in U.S. Pat. No. 5,681,359, incorporated herein by reference.

TABLE 4

| | Temperature Difference (° C.) | | |
|---|---|---|---|
| Fuel | 90%–20% | 90%–FBP | FBP(° C.) |
| 1 | 71 | 34 | 356 |
| 2 | 88 | 38 | 352 |
| 3 | 87 | 21 | 357 |
| 4 | 89 | 14 | 346 |
| 5 | 77 | 33 | 356 |
| 6 | 85 | 39 | 352 |
| 7 | 93 | 32 | 370 |
| 8 | 84 | 39 | 367 |
| 9 | 107 | 31 | 364 |
| 10 | 107 | 19 | 356 |

If the fuel met at least one of the above three evaluation parameters, i.e., 90%–20% distilled temperature difference, 90%-final boiling point distilled temperature difference, or final boiling point, it was considered hard to treat. Based on the evaluation parameters and the data in Tables 3 and 4, fuels 1 through 8 and 10 are considered hard to treat, and fuel 9 is considered normal. As the following examples demonstrate, the cloud point additives of the invention have beneficial effects when used with both normal and hard-to-treat fuels.

EXAMPLE 1

The cloud points of three fuel compositions were compared. The fuel used in preparing each of the compositions was Fuel 1. The first fuel composition contained no added cloud point depressant. The second fuel composition included 500 ppm by weight of Polyimide I. The third fuel composition included 500 ppm by weight of Maleic Copolymer 1. The results are set out in Table 5.

TABLE 5

| | Cloud Point | |
|---|---|---|
| Additive | ° C. | ° F. |
| — | −7 | 19.4° |
| Polyimide I | −13 | 8.6° |
| Maleic Copolymer I | −10 | 14° |

EXAMPLE 2

The effect of change in concentration of cloud point depressant additive on the cloud point was evaluated using Fuel 2. The two additives tested above in Example 1 were separately combined with Fuel 2 and evaluated for cloud point depressant effect at additive concentrations of 500 ppm and 1000 ppm by weight. The cloud point temperatures are set out in Table 6.

TABLE 6

| | Concentration | Cloud Point | |
|---|---|---|---|
| Additive | (ppm) | ° C. | ° F. |
| 1) — | — | −13 | 8.6 |
| 2) Polyimide I | 500 | −19 | −2.2 |
| 2a) Polyimide I | 1,000 | −20 | −4 |
| 3) Maleic Copolymer I | 500 | −15 | 5 |
| 3a) Maleic Copolymer I | 1,000 | −16 | 3.2 |

An improvement was observed by using 1,000 ppm additive when compared with the same additive at a 500 ppm concentration level. However, the change in cloud point from 500 ppm to 1,000 ppm additive level was not as great as the cloud point change from 0 ppm to 500 ppm additive level for both Polyimide I and Maleic Copolymer 1.

EXAMPLE 3

The cloud point depressant effect of the two additives tested in Examples 1 and 2 was evaluated on other distillate fuels when introduced at a concentration of 500 ppm by weight. The results are set out below in Table 7.

TABLE 7

| | | Cloud Point | |
|---|---|---|---|
| Fuel | Additive | ° C. | ° F. |
| 3 | — | −10 | 14 |
| 3 | Polyimide I | −15 | 5 |
| 3 | Maleic Copolymer I | −11.5 | 11.3 |
| 4 | — | −11 | 12.2 |
| 4 | Polyimide I | −15 | 5 |
| 4 | Maleic Copolymer I | −13 | 8.6 |

EXAMPLE 4

To evaluate the effect of substituent chain length on the ability of the additive to lower the cloud point, a number of additive compositions were added to Fuel 1 and Fuel 3 at a concentration of 500 ppm by weight. The compositions of the tested additives are set out in Table 1 above. The additives and test results are provided below in Table 8.

TABLE 8

| | Cloud Point | | | |
|---|---|---|---|---|
| Additive | Fuel Composition [Fuel 1] | | Fuel Composition [Fuel 3] | |
| (500 ppm by wt.) | ° C. | ° F. | ° C. | ° F. |
| — | −7 | 19.4 | −10 | 14 |
| Polyimide I | −13 | 8.6 | −15 | 5 |
| Maleic Copolymer I | −10 | 14 | −11.5 | 11.3 |
| Maleic Copolymer II | −9 | 15.8 | −8 | 17.6 |
| Maleic Copolymer III | −9 | 15.8 | −11 | 12.2 |
| Maleic Copolymer IV | −7 | 19.4 | −12 | 10.4 |
| Maleic Copolymer V | −10 | 14 | −10.8 | 12.6 |
| Polyimide II | −8 | 17.6 | −11 | 12.2 |
| Polyimide III | −8 | 17.6 | −11 | 12.2 |

TABLE 8-continued

| Additive (500 ppm by wt.) | Cloud Point: Fuel Composition [Fuel 1] ° C. | Fuel Composition [Fuel 1] ° F. | Fuel Composition [Fuel 3] ° C. | Fuel Composition [Fuel 3] ° F. |
|---|---|---|---|---|
| Polyimide IV | −8 | 17.6 | −11 | 12.2 |
| Polyimide V | −9 | 15.8 | −7 | 19.4 |

As the above data indicate, the extent of the cloud point depressant effect will vary with the fuel to be treated. Polyimide I and Maleic Copolymer I demonstrated good cloud point depressant efficacy with both Fuels 1 and 3. The cloud point depressant effect of the remaining additives in Table 8 was generally not as significant nor as uniform with both Fuels 1 and 3 as was observed with Polyimide I and Maleic Copolymer I.

EXAMPLE 5

To demonstrate the utility of a cloud point depressant additive used with a variety of fuels, several of which are classified as hard-to-treat, Polyimide I was incorporated into a number of different fuels at 500 ppm concentration by weight and evaluated for cloud point depressant effect. The results of this evaluation are provided in Table 9 below.

TABLE 9

| Fuel | CLOUD POINT: Untreated ° C. | Untreated ° F. | With 500 ppm Polyimide I ° C. | With 500 ppm Polyimide I ° F. |
|---|---|---|---|---|
| 4 | −11 | 12.2 | −15 | 5 |
| 5 | −11 | 12.2 | −13 | 8.6 |
| 6 | −10 | 14 | −18 | −0.4 |
| 7 | −9 | 15.8 | −14 | 6.8 |
| 8 | −10 | 14 | −14 | 6.8 |
| 9 | −10 | 14 | −15 | 5 |
| 10 | −13 | 8.6 | −17 | 1.4 |

As the data indicate, Polyimide I at 500 ppm concentration in Fuels 4 through 10 produced a cloud point depressant effect up to 8° Celsius over the group of fuels, and typically at least 4° Celsius.

EXAMPLE 6

To evaluate the effect of an ethylene vinyl acetate isobutylene terpolymer on the cloud point of a distillate fuel, several fuels were combined with 500 ppm terpolymer or copolymer additive and measured for cloud point. The results of this evaluation are provided in Table 10 below.

TABLE 10

| Fuel | Additive (500 ppm by wt.) | CLOUD POINT ° C. | ° F. |
|---|---|---|---|
| 1 | — | −7 | 19.4 |
| 1 | Terpolymer I | −10 | 14 |
| 1 | Terpolymer III | −11 | 12.2 |
| 1 | Copolymer I | −6 | 21.2 |
| 3 | — | −10 | 14 |
| 3 | Terpolymer I | −12 | 10.4 |

TABLE 10-continued

| Fuel | Additive (500 ppm by wt.) | CLOUD POINT ° C. | ° F. |
|---|---|---|---|
| 3 | Terpolymer II | −12 | 10.4 |
| 3 | Copolymer I | −11 | 12.2 |
| 7 | — | −9 | 15.8 |
| 7 | Terpolymer II | −11 | 12.2 |
| 7 | Terpolymer III | −11 | 12.2 |
| 8 | — | −10 | 14 |
| 8 | Terpolymer III | −12 | 10.4 |

Generally, incorporation of a terpolymer additive to the respective fuels resulted in a demonstrable cloud point depressant effect. Incorporation of a copolymer additive either had the undesirable effect of raising the cloud point, or of providing a less substantial positive effect on cloud point depression compared to the terpolymer additives tested.

EXAMPLE 7

In formulating additive packages for modifying more than one property of a fuel, the effect of one additive may not positively correlate to that of another additive. Thus, an additive incorporated to improve one property of a fuel may have an adverse effect on another property of the fuel.

It has been found that an ethylene vinyl acetate copolymer or an ethylene vinyl acetate isobutylene terpolymer, which can be used to improve the cold flow properties of the fuel, combined with a polyimide or maleic anhydride α-olefin copolymer of the invention generally does not have an antagonistic effect on either the cloud point or cold flow characteristics of the fuel. In this evaluation, an additive package consisting of 500 ppm by weight of a 1:1 mixture of either copolymer or terpolymer and polyimide I was combined with a variety of fuels and measured for cloud point depression. The additive package combinations and cloud point measurements are set out in Table 11 below.

TABLE 11

| Fuel | Additive (by weight) | Cloud Point ° C. | ° F. |
|---|---|---|---|
| 1 | — | −7 | 19.4 |
| 1 | 250 ppm TerpolymerI/250 ppm Polyimide I | −12 | 10.4 |
| 1 | 250 ppm Terpolymer III/250 ppm Polyimide I | −11 | 12.2 |
| 1 | 250 ppm Copolymer I/250 ppm Polyimide I | −9 | 15.8 |
| f | | | |
| 2 | — | −13 | 8.6 |
| 2 | 250 ppm Copolymer I/250 ppm Polyimide I | −17 | 1.4 |
| 2 | 250 ppm Copolymer I/500 ppm Polyimide I | −17 | 1.4 |
| 2 | 250 ppm Terpolymer I/250 ppm Polyimide I | −17 | 1.4 |
| 2 | 250 ppm Terpolymer I/500 ppm Polyimide I | −19 | −2.2 |

To evaluate the effect of this type of additive combination on fuel cold flow, several additive combinations were tested for Cold Filter Plugging Point (CFPP), IP 309, incorporated herein by reference, or pour point, ASTM D 97, also incorporated herein by reference. Specifically Fuel 2 both without additives and with certain additive combinations was tested for CFPP and pour point. Without additives the CFPP of Fuel 2 was −15.5° C. Incorporation of 250 ppm Copolymer I and 250 ppm Polyimide I into Fuel 2 improved the CFPP to −22° C.

The pour point of Fuel 2 was −21° C. without additive. Incorporation of 250 ppm Copolymer I and 500 ppm Polyimide I improved the pour point to −44° C., and incorporation of 250 ppm Terpolymer I and 500 ppm Polyimide I improved the pour point to −50° C.

EXAMPLE 8

Several fuel compositions containing cloud point depressant additives were evaluated for low temperature flow performance utilizing the Low Temperature Flow Test (LTFT), ASTM D 4539, incorporated herein by reference. This test estimates the filterability of diesel fuels in some automotive equipment at low temperatures. Broadly, the test involves cooling the fuel to be tested to a temperature initially at least 5% above the wax appearance point (ASTM D 3117) or the cloud point (ASTM D 2500). After the sample has cooled to the desired temperature the sample is gently stirred to disperse any settled wax crystals and then drawn through a filter under vacuum. The sample passes at a given test temperature if at least 180 milliliters of sample passes through the filter within sixty seconds.

In the test, three fuels were evaluated, each containing 500 ppm Polyimide I as the additive. Cloud point and LTFT data are provided in Table 12 below.

TABLE 12

| | | | LTFT (° C.) | |
|---|---|---|---|---|
| Fuel | Additive | Cloud Point (° C.) | Passed | Failed |
| 1 | 500 ppm Polyimide I | −13 | −14 | −15 |
| 3 | 500 ppm Polyimide I | −15 | −17 | −18 |
| 9 | 500 ppm Polyimide I | −15 | −20 | Unknown[1] |

[1]The test system employed a low end temperature limit of −20° C. The sample required 18 seconds to pass the required quantity of fuel at this temperature limit. The ultimate failure temperature for this composition would be lower than −20°

The data demonstrates that the passed LTFT values for the tested fuel compositions containing additive were consistently lower than the respective cloud points of these compositions.

As the above examples demonstrate, the additives of the invention provide substantial improvements in the cloud point properties of distillate fuels relative to the unmodified fuel. The improvement in cloud point depression extends to both normal and hard-to-treat fuels. These additives may be used in combination with other fuel additives, such as those for improving flow properties to enhance the operability of the fuel by encompassing the cloud point depression improvement as well as the properties improved by incorporation of the other additives.

Thus it is apparent that there has been provided, in accordance with the invention, a cloud point depressant additive and fuel composition which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, departures may be made from such details without departing from the spirit or scope of the general inventive concept.

What is claimed is:

1. A distillate fuel composition having improved cloud point depressant properties comprising a major proportion of a distillate fuel and an improved cloud point depressant effective amount of a polyimide having the formula:

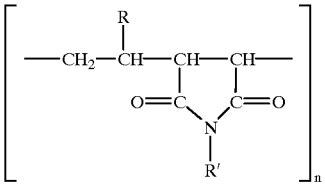

wherein R has at least 80% by weight of a hydrocarbon substituent from about 14 to about 16 carbons, R' has at least 80% by weight of a hydrocarbon substituent from 16 to 18 carbons, and n is from 2 to about 17.

2. The distillate fuel composition of claim 1 wherein R has at least 90% by weight of a hydrocarbon substituent from about 14 to about 16 carbons.

3. The distillate fuel of claim 1 wherein R has at least 95% by weight of a hydrocarbon substituent from about 14 to about 16 carbons.

4. The composition of claim 1 wherein said distillate fuel is a middle distillate fuel.

5. The composition of claim 1 wherein said distillate fuel is No. 2 diesel fuel.

6. The composition of claim 1 wherein said distillate fuel is hard-to-treat fuel.

7. The composition of claim 1 wherein said polyimide is derived from substantially equimolar proportions of maleic anhydride and α-olefin.

* * * * *